US005862543A

United States Patent [19]

Reynoso et al.

[11] Patent Number: 5,862,543

[45] Date of Patent: Jan. 26, 1999

[54] USER-SELECTABLE MULTI-JET ASSEMBLY FOR JETTED BATHS/SPAS

[75] Inventors: Arturo S. Reynoso, Azuza; Cleo D. Mathis, Hacienda Heights; Robert A. Miller, Huntington Beach, all of Calif.

[73] Assignee: Vico Products Manufacturing Co., South El Monte, Calif.

[21] Appl. No.: 966,410

[22] Filed: Nov. 7, 1997

[51] Int. Cl.[6] ..... A61H 33/04

[52] U.S. Cl. ..... 4/541.6; 4/541.3; 4/541.4; 4/492; 129/394

[58] Field of Search ..... 4/541.3, 541.4, 4/541.6, 567, 492; 239/394, 443, 538

[56] References Cited

U.S. PATENT DOCUMENTS 659,714 10/1900 Storm ..... 239/394

FOREIGN PATENT DOCUMENTS 154677 1/1954 Australia ..... 239/394

3-253627 11/1991 Japan ..... 4/541.6

*Primary Examiner*—David J. Walczak
*Assistant Examiner*—Tuan N. Nguyen
*Attorney, Agent, or Firm*—Wallace G. Walter

[57] ABSTRACT

A user-selectable multi-jet assembly (10) for jetted baths/spas includes a faceplate assembly (12) having a first set of three user-selectable ball-type nozzles (14) and a second set of three user-selectable swirler-type nozzles (16). The faceplate assembly 12 is bidirectionally rotatable about an axis $A_x$ between two user-selectable positions in which either the ball-type nozzles (14) or the swirler-type nozzles (16) are selected. The multi-jet assembly (10) includes a housing (46) into which both water and air are supplied and internal distribution tubes (28) through which water is directed into the user-selected nozzles. The faceplate assembly (12) is connected to an internal rear valve plate (50) that cooperates with a stator (52) to effectively interrupt water flow through the nozzles as the faceplate assembly (12) is rotated from one user-selected position to the other.

9 Claims, 6 Drawing Sheets

USER-SELECTABLE MULTI-JET ASSEMBLY FOR JETTED BATHS/SPAS

BACKGROUND OF THE INVENTION

The present invention relates to an user-selectable multi-jet assembly for jetted baths/spas. In the hot tub and jetted tub/spa market, various types of jets are known for introducing a jet or spray of water and air into the interior of the tub. The most common jets include those having an apertured ball or sphere, known an "eyeball," that can be pointed or steered by the user in a desired direction. Another type of jet, such as that disclosed in U.S. Pat. No. 5,291,621 issued Mar. 8, 1994, includes a rotor body having a plurality of sub-nozzles that spray plural water/air jets into the tub. The rotor body is designed to rotate about an axis to provide a multi-stream water/air jet pattern that rotates or "swirls" about the axis of the rotor.

In general, once a jet assembly is installed into the hot tub or spa, be it a single pointable nozzle or a multi-jet swirling-nozzle assembly, the user is thereafter limited to that jet type. In order to overcome this limitation, a need exists for a multi-jet system in which the user can conveniently select the jet type desired.

SUMMARY OF THE INVENTION

In view of the above, it is an object of the present invention, among others, to provide a user-selectable multi-jet assembly for jetted baths/spas in which the user can select one of at least two jets types.

It is another object of the present invention to provide a user-selectable multi-jet assembly for jetted baths/spas in which the user can select between a pointable air/water stream or a swirling-stream type of jet.

It is still another object of the present invention to provide an user-selectable multi-jet assembly for jetted baths/spas in which the user can select between multiple ones of a pointable air/water stream or multiple ones of a swirling-stream type of jet.

In view of these objects, and others, the present invention provides a user-selectable multi-jet assembly for jetted baths/spas. The assembly includes a rotatable faceplate carrying a plurality of nozzles of a first type and an alternate plurality of nozzles of a second type. The faceplate is rotatably carried in a facia ring secured through the tub structure to a housing that carries a combined water-distribution and air-induction assembly. Water and induced air from the manifold/air-induction assembly is selectively provided to the nozzles of the first type or nozzles of the second type as selected by the user. In the preferred embodiment, the first-type nozzles are user-pointable nozzles and the second-type nozzles are swirling-jet nozzles.

The present invention advantageously provides a user-selectable multi-jet assembly for jetted baths/spas in which a user can select between first and at least second nozzle types.

Other objects and further scope of applicability of the present invention will become apparent from the detailed description to follow, taken in conjunction with the accompanying drawings, in which like parts are designated by like reference characters.

DESCRIPTION OF THE PREFERRED EMBODIMENT

Figure 2:
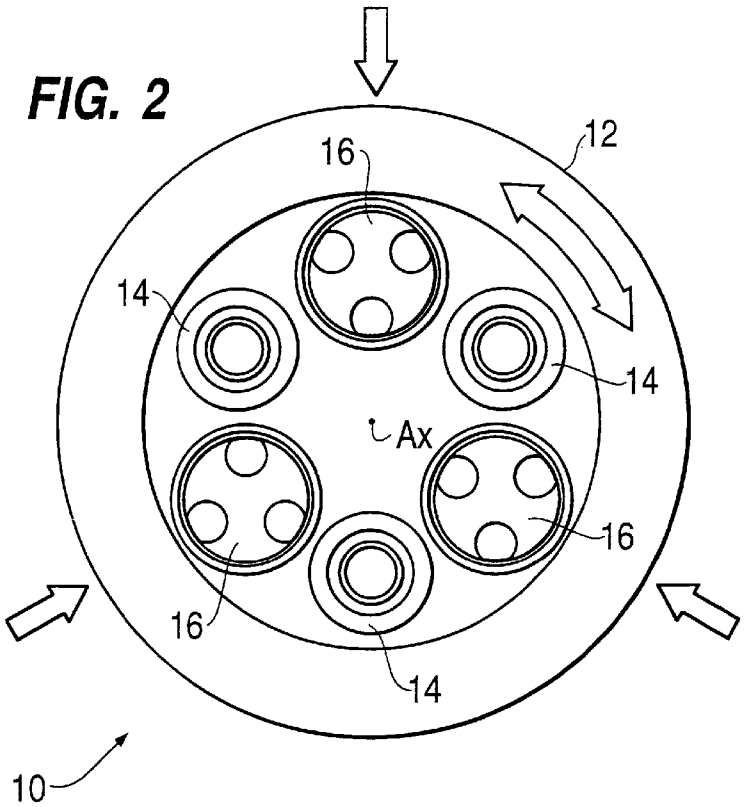
FIG. 2 is a front elevational view of the user-selectable multi-jet assembly of FIG. 1 in a second, user-selected position.
Figure 1:
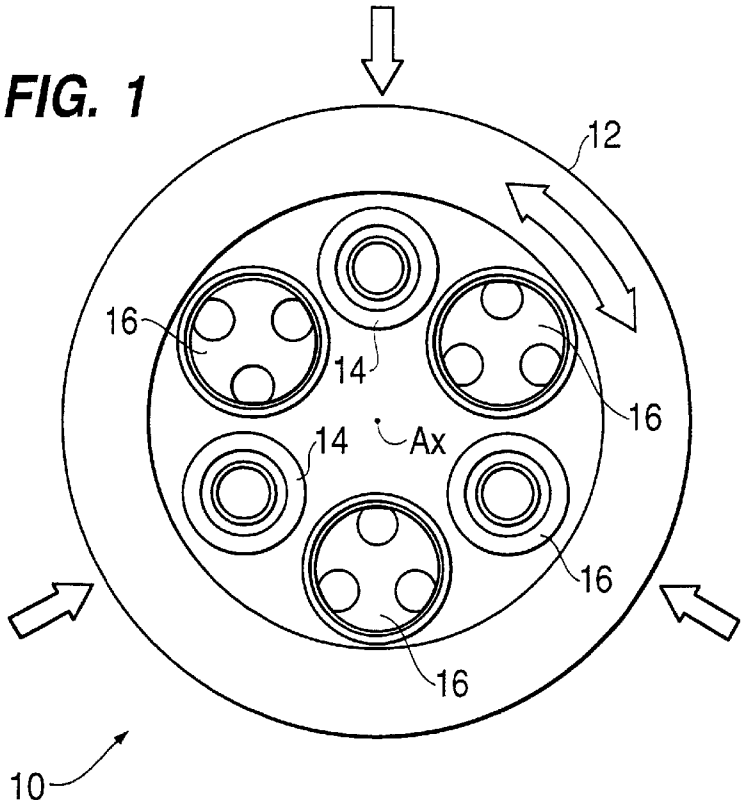
FIG. 1 is a front elevational view of a user-selectable multi-jet assembly in a first, user-selected position.

An user-selectable multi-jet assembly for jetted baths/spas in accordance with the present invention is shown in front elevation in FIG. 1 and in FIG. 2 and designated generally therein by the reference character 10. As shown, the multi-jet assembly 10 includes a circular faceplate assembly 12 that carries, in the case of the preferred embodiment, six nozzle stations (unnumbered) equispaced about an axis $A_x$. The faceplate assembly 12 is bidirectionally rotatable about the axis $A_x$ between two user-selectable positions, as represented by the bidirectional arrow. A first position is shown in FIG. 1, and the second position is shown in FIG. 2. As explained below, the rotary movement of the faceplate assembly 12 is constrained between defined limits, and the faceplate assembly 12 is held in either of its positions by a detent or by frictional engagement of the cooperating parts.

In the preferred embodiment, three of the nozzle stations carry a nozzle of a first type, i.e., a user-pointable ball-type nozzle 14 while the remaining three nozzles carry a nozzle of a second type, i.e., a multi-jet swirler-type nozzle 16. The ball-type nozzles 14 are carried in alternate, non-adjacent nozzle stations, and the swirler-type nozzles 16 occupy the intermediate nozzle stations. As shown in FIG. 1, the faceplate assembly 12 can be rotated to the first operative position in which the ball-type nozzles 14 are selected (as indicated by the three, equispaced arrows) and the second operative position in which the swirler-type nozzles 16 are selected. Thus, the user can select three pointable ball-type nozzles 14 or three multi-jet swirler-type nozzles 16.

Figure 3:
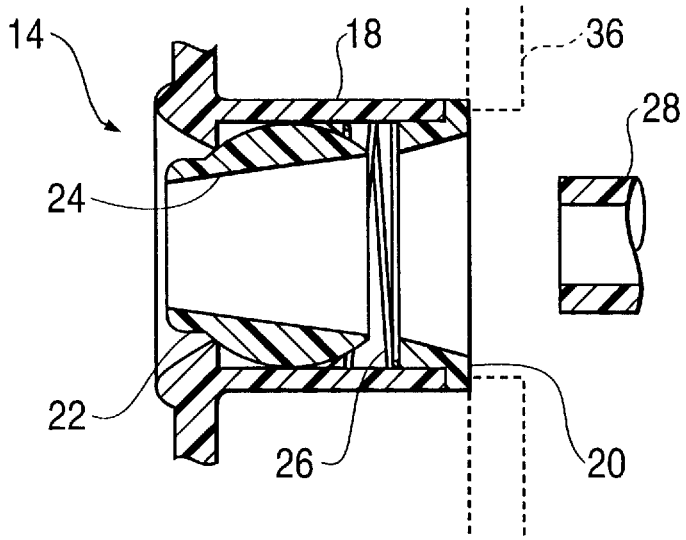
FIG. 3 is a cross-sectional view of a first exemplary type of nozzle, i.e., a user-pointable "eyeball" nozzle.

As shown in the cross-sectional detail of FIG. 3, each ball-type nozzle 14 is housed in a nozzle station defined by a cylindrical tube 18 (integrally molded with the faceplate assembly 12) with a retainer cap 20 secured to the end of the cylindrical tube 18. The retainer cap 20 may be secured to the end of the cylindrical tube 18, for example, by ultrasonic welding or by solvent welding. A spheroidal ball 22 having a ball bore 24 is carried in the cylindrical tube 18 and resiliently retained in place by a helical spring 26 in compression between the retainer cap 20 and the ball 22. As shown in FIG. 3, the ball bore 24 converges toward the end thereof that faces the user. The ball 22 may be pointed or oriented in a desired position by the user with the selected position maintained by the helical spring 26. The end of a distribution tube 28 is shown to the right of the retainer cap 20. As explained in more detail below, pressurized water is directed from the end of the distribution tube 28 into the ball bore 24 with air entrained into the water flow from the distribution tube 28 to provide a water/air mixture through the ball bore 24.

Figure 4:
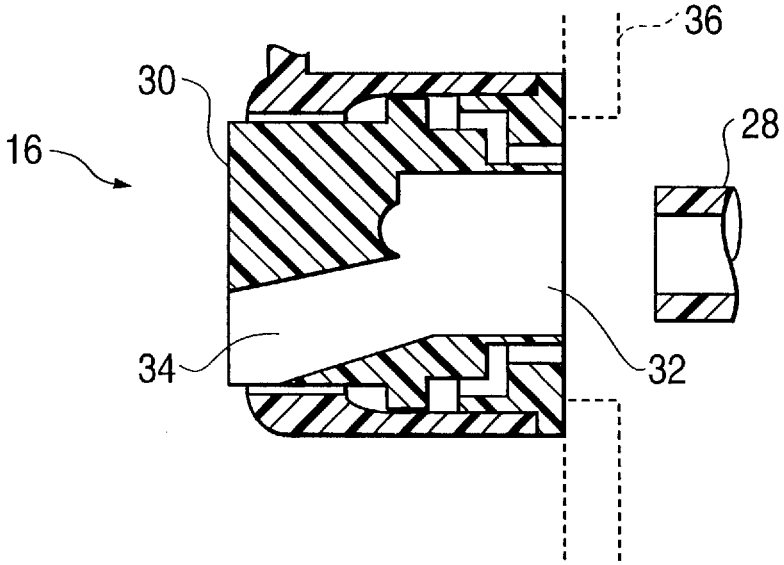
FIG. 4 is a cross-sectional view of second exemplary type nozzle, i.e., a swirling multi-jet nozzle.

As shown in FIG. 4, a generally cylindrical swirl-rotor 30 is retained within the nozzle station for rotation about its axis. The swirl-rotor 30 includes a entry port 32 that separates into three output ports 34 (only one of which is shown in FIG. 4). Each output port 34 is aligned at an angle relative to and is also skewed relative to the axis of rotation of the swirl-rotor 30 so that the swirl-rotor 30 will rotate in a desired clockwise or counterclockwise direction (depending upon the angular relationship of the output ports 34 to the axis of rotation). As in the case of the ball-type nozzle 14 described above, the end of a distribution tube 28 is shown to the right of the retainer cap 20 for the swirler-type nozzle 16. Pressurized water is directed from the distribution tube 28 into the entry port 32 with air entrained into the water flow from the distribution tube 28 to provide a water/air mixture through the output ports 34 to provide three separate water/air streams that swirl or twirl about the axis of rotation of the swirl-rotor 30.

As shown in dotted-line illustration in both FIG. 3 and FIG. 4, a front valve plate 36 is resiliently pressed or urged against the retainer caps 20 of the various nozzle stations. As explained more fully below, the front valve plate 36 includes through openings that co-align with the nozzle stations when the faceplate assembly 12 is rotated by the user to select the ball-type nozzles 14 or select the swirler-type nozzles 16. When the faceplate assembly 12 is rotated to a position intermediate the nozzle selection positions (i.e., when the user changes nozzle selection), the retainer caps 20 are effectively wiped onto a portion of the front valve plate 36 between the through openings to cut off fluid flow through the ball-type nozzles 14 and the swirler-type nozzles 16 while the user is rotating the faceplate assembly 12 from one position to the other. Also as explained below, a rear valve plate concurrently interrupts or cuts off water flow through the distribution tubes 28 so that any water flow through the various parts is substantially halted during movement of the faceplate assembly 12 from one position to the other.

Figure 6:
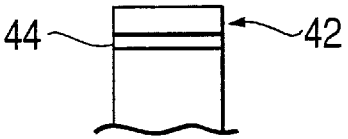
FIG. 6 is a detail elevational view of a tab structure taken along line 6—6 of FIG. 5.
Figure 7:
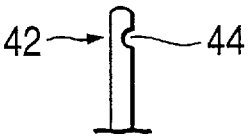
FIG. 7 is a side view of the tab structure of FIG. 6.
Figure 5:
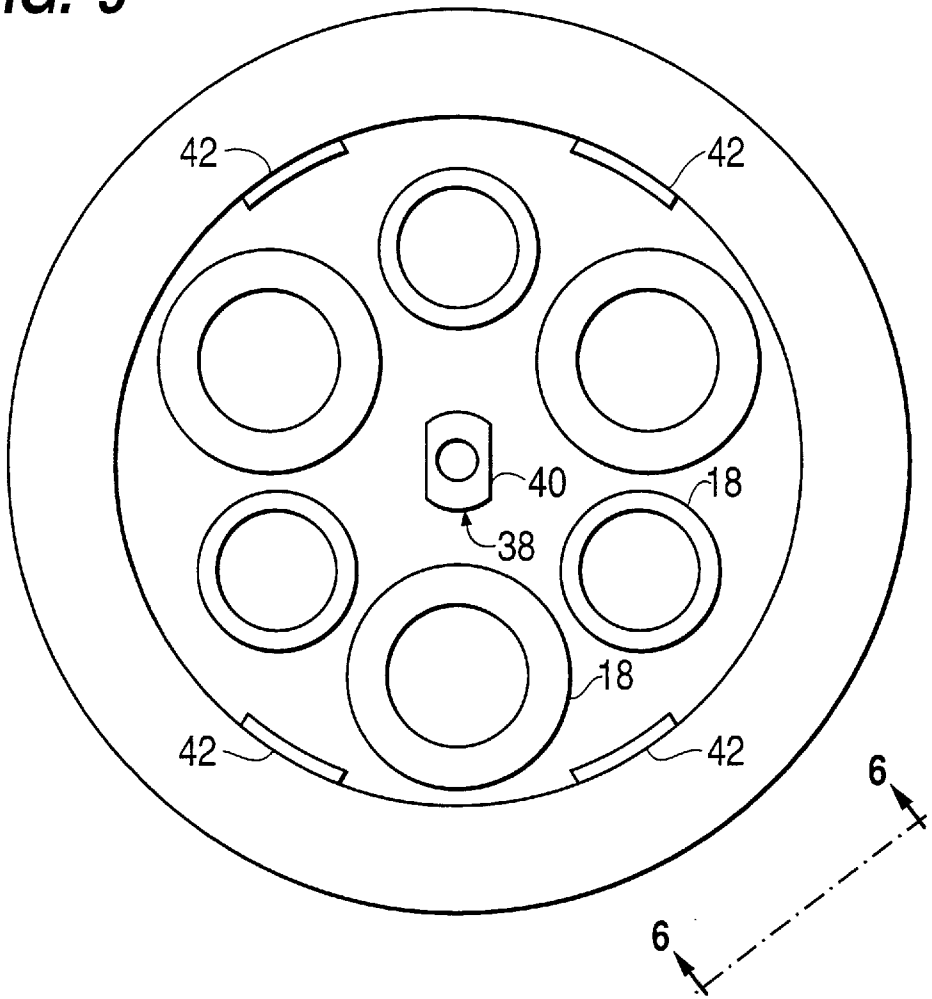
FIG. 5 is rear view of a faceplate assembly of the present invention, the front view being shown in FIGS. 1 and 2.

FIG. 5 illustrates the rear side of the faceplate assembly 12, i.e., the side opposite that shown in FIG. 1 and FIG. 2. As shown, the six cylindrical tubes 18 are positioned about a coaxially aligned stem 38. The stem 38 is integrally formed with the faceplate assembly 12 and is formed with a pair of parallel, chordal flats 40. The stem 38 is designed, as explained below, to connect to and rotate a rear valve plate assembly as the faceplate assembly 12 is rotated by the user to select one set of jets or the other. The cylindrical tubes 18 for the swirler-type nozzles 16 are of a diameter somewhat larger that the cylindrical tubes 18 for the ball-type nozzles 14. Four tabs 42 are formed about a selected base circle and, as shown in the details of FIG. 6 and FIG. 7, each tab 42 includes a groove 44 near the remote end thereof. As explained below, the tabs 42 cooperate with a circular ridge (describe below) to assist in securing the parts together.

Figure 8:
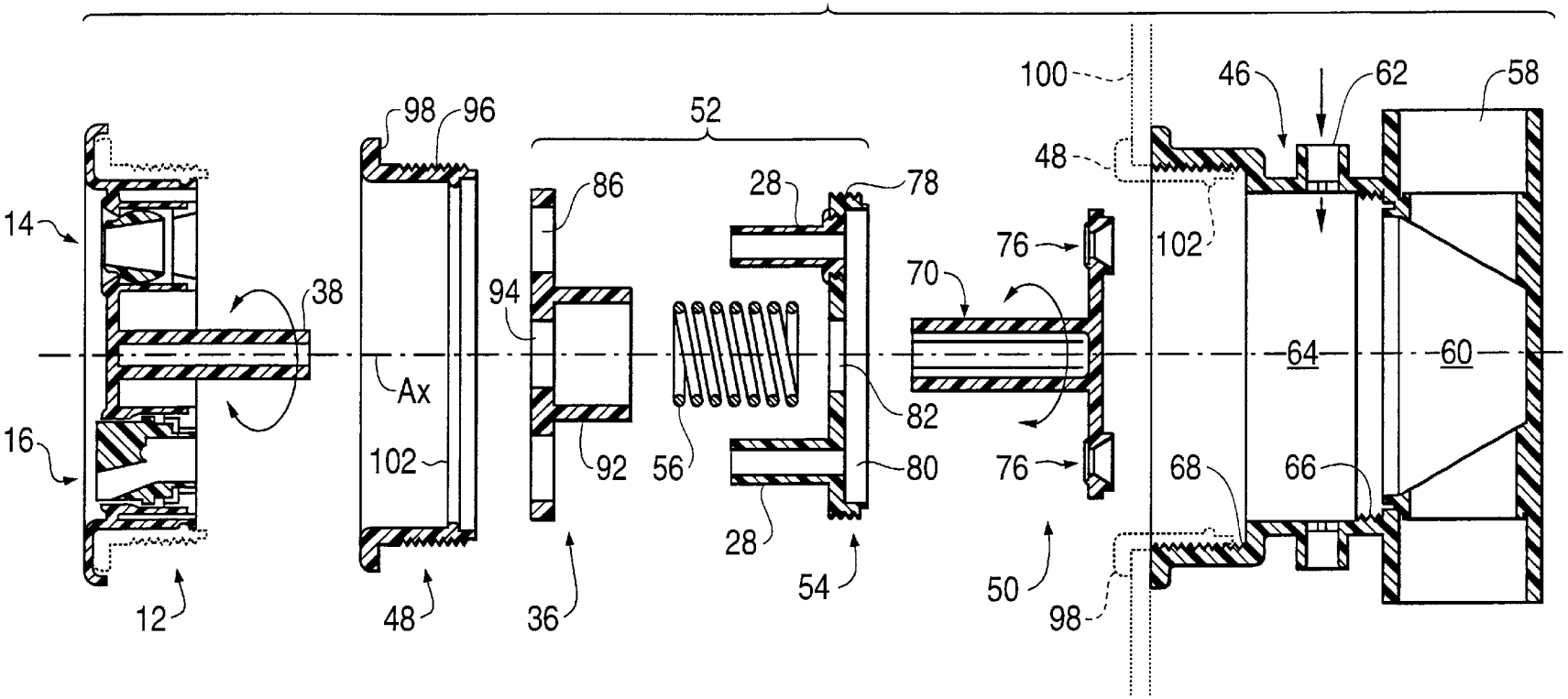
FIG. 8 is an exploded cross-sectional view of the multi-jet assembly of the present invention.

FIG. 8 illustrates the major components of the multi-jet assembly 10 in exploded form with selected structure omitted for reasons of clarity. In FIG. 8, the left side of the figure represents the front or forward end of the multi-jet assembly 10 that faces toward the interior of the tub while the right represents the rear or rearward end of the multi-jet assembly 10.

The multi-jet assembly 10 includes the faceplate assembly 12, described above, a housing 46 into which the major components are assembled, a retaining ring 48, a rotatably mounted rear valve plate 50, and a water control stator 52 that includes a manifold plate 54 and the front valve plate 36 that is biased into the faceplate assembly 12 by a helical spring 56. The manifold plate 54 carries three distribution tubes 28 (only two of which are shown in FIG. 8) that each conduct water streams provided through the rear valve plate 50 to the faceplate assembly 12. As explained in more detail below, the faceplate assembly 12 is connected to the rear valve plate 50 through the stem 38 so that rotation of the faceplate assembly 12 by the user also rotates the rear valve plate 50 with water streams directed through the distribution tubes 28 through openings in the front valve plate 36 into the selected nozzle stations of the faceplate assembly 12. The faceplate assembly 12 and the connected rear valve plate 50 thus define a rotor (unnumbered) that cooperates with the stator 52 to control water flow through the multi-jet assembly 10. As the faceplate assembly 12 is rotated from one position to the other, the rear valve plate 50 momentarily interrupts water flow to the distribution tubes 28, and the front valve plate 36 momentarily interrupts flow through the various nozzles.

The housing 46 and the related internal components are preferably molded from a thermosetting plastic, such as DELRIN, and includes a water inlet 58 that leads into a water chamber 60 and an air inlet 62 that leads into an air plenum 64. In general, pressurized water is supplied to the water inlet 58 from a water distribution pipe, which, in turn, is connected to a motor driven pump, as is common in this technology. Internal threads 66 are formed between the water chamber 60 and the air plenum 64 and are designed to receive the manifold plate 54. Internal threads 68 are formed at the forward end of the housing 46 and are designed to receive the retaining ring 48 (as shown in dotted-line illustration).

Figure 9:
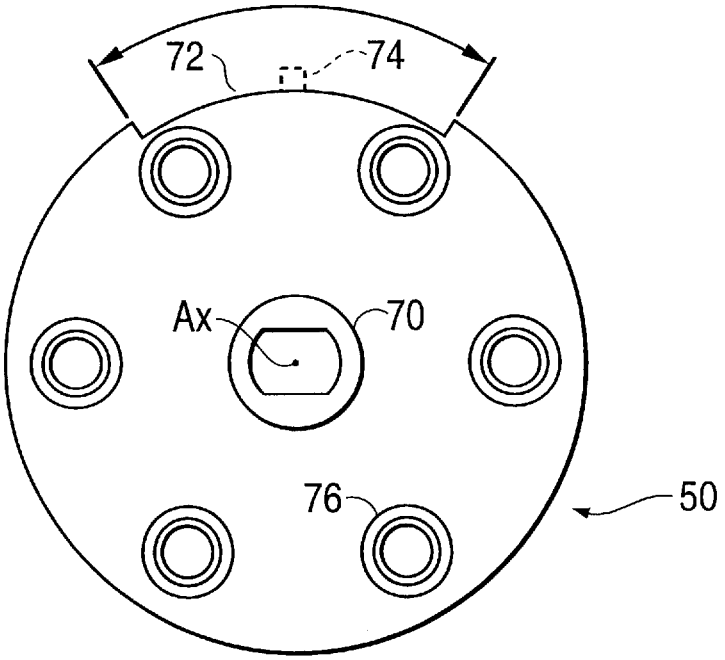
FIG. 9 is a front view of a rear valve plate.

As shown in profile in FIG. 8 and in a frontal view in FIG. 9, the rear valve plate 50 is formed as a generally circular member about the axis $A_x$ and includes a forwardly extending stem receiver 70 that is formed with an internal profile that accepts the above described stem 38 in a slip-fit torque-transmitting engagement. Thus, rotation of the faceplate assembly 12 in one direction or the other (as shown in FIG. 1 and FIG. 2) will cause the rear valve plate 50 to also rotate therewith. The rear valve plate 50 is formed with a notch 72 along part of its periphery (i.e., about a 60 degree arc). As represented in dotted-line illustration, a key 74 (which is part of the manifold plate 54) is positioned within the notch 72 when the parts are assembled and functions to limit the rotary motion of the rear valve plate 50 and the connected faceplate assembly 12. The rear valve plate 50 includes six venturi-type openings 76 formed on and equispaced along a base circle having a selected diameter about the axis $A_x$. As shown in the side view of FIG. 8, each venturi-type opening 76 has a profile that converges toward the forward end of the multi-jet assembly 10.

Figure 10:
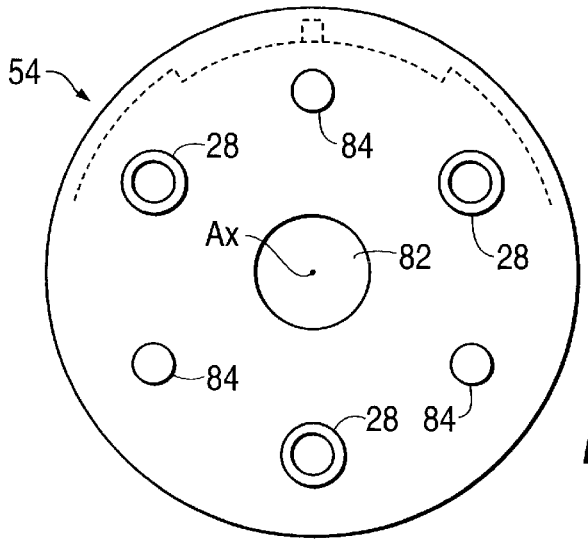
FIG. 10 is a front view of a distribution manifold.

As shown in the FIG. 8 and in FIG. 10, the manifold plate 54 is formed as a generally circular member with external threads 78 designed to engage the internal threads 66 of the housing 46. The manifold plate 54 includes a counterbore 80 on its rearward side into which the body of the rear valve plate 50 is received and a central opening 82 through which the stem receiver 70 extends when the two parts are assembled. The manifold plate 54 includes three equispaced distribution tubes 28 and alternating equispaced cylindrical posts 84. When the manifold plate 54 is threaded into engagement in the housing 46 with the rear valve plate 50 rotatably captured within the counterbore 80, the rear valve plate 50 is free to rotate between its two user selectable positions with one set of three venturi-type openings 76 aligned with the distribution tubes 28 or the other set of three venturi-type openings 76 aligned with the distribution tubes 28. The above-described key 74, which is integrally molded at the periphery of the counterbore 80, cooperates with the notch 72 to limit the rotary motion of the rear valve plate 50 within the counterbore 80 of the manifold plate 54 to about a 60° arc. When the rear valve plate 50 is positioned in either of its extreme positions, three of the venturi-type openings 76 are aligned with the three distribution tubes 28 so that water under pressure will flow through the venturi-type openings 76 into the co-aligned distribution tubes 28 and through the selected nozzles. When the rear valve plate 50 is rotated to an intermediate position (as when the user is moving the faceplate assembly 12 from one position to another), the venturi-type openings 76 are no longer co-aligned with the distribution tubes 28 and, accordingly, water flow through the distribution tubes 28 is momentarily interrupted.

Figure 11:
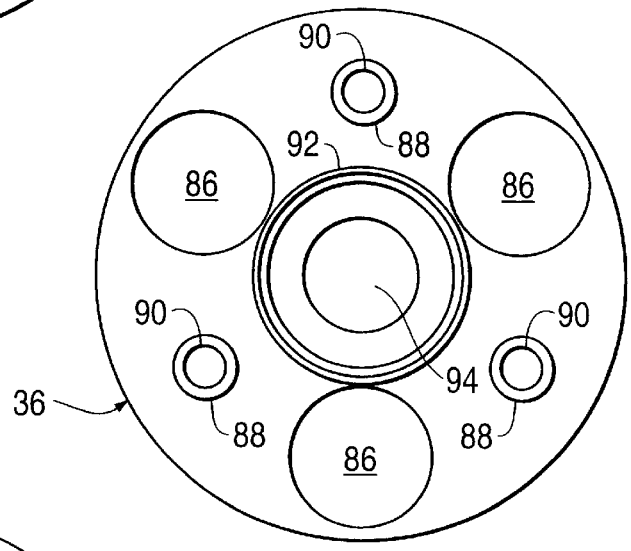
FIG. 11 is a rear veiw of a front valve plate.

FIG. 11 is a rearward view of the front valve plate 36 and, as shown, the front valve plate 36 is formed as a generally circular member about the axis $A_x$. The front valve plate 36 includes three openings 86 equispaced on a common diameter and three similarly spaced post-receiving members 88. The post-receiving members 88 are each formed as a hollow cylinder having a cylindrically extending bore 90 that is designed to receive the post 84 of the manifold plate 54 in a sliding fit engagement. An annular wall 92 extends rearwardly from the rear surface of the front valve plate 36 and surrounds a center opening 94 through which the stem receiver 70 of the rear valve plate 50 extends. The helical spring 56 is contained within the cavity defined by the annular wall 92 and, when the stator 52 is assembled, is designed to resiliently urge the forward-facing surface of the front valve plate 36 against the retainer caps 20 at the rearward end of the faceplate assembly 12. The posts 84 on the front valve plate 36 are received within the post-receiving members 88 of the manifold plate 54 to allow a measure of forward and rearward movement along the axis $A_x$.

Figure 12:
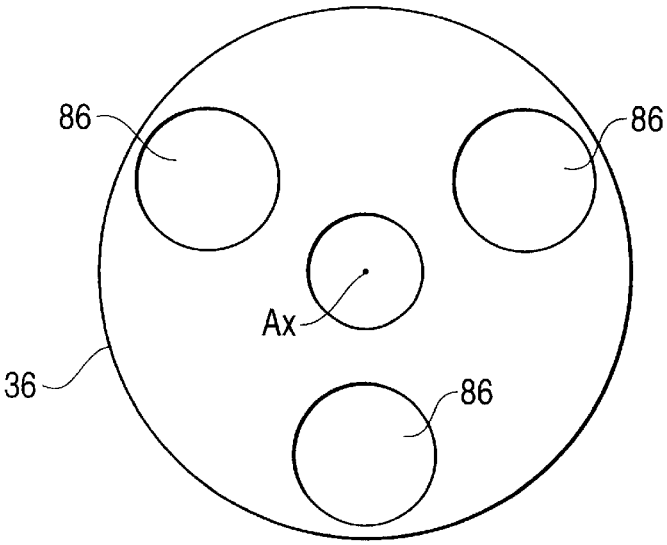
FIG. 12 is a front view of the front valve plate of FIG. 11.

FIG. 12 illustrates the front or forward facing surface of the front valve plate 36. As shown, the three openings 86 are equispaced along a common base circle about the center opening 94. The forward surface of the front valve plate 36 shown in FIG. 12 is resiliently pressed against the rearward surface of the faceplate assembly 12. As the user selects one of the two available positions, the rear surfaces of the retainer caps 20 will wipe across the front of the stationary front valve plate 36 with one set of nozzle stations or the other being co-aligned with the openings 86. Since the front valve plate 36 is mated to the manifold plate 54 via the posts 84 and the post-receiving members 88, the ends of the distribution tubes 28 are aligned coaxially with each opening 86.

The retaining ring 48 includes external threads 96 that mate with the internal threads 68 of the housing 48. As shown on the right side of FIG. 8 in dotted-line illustration, the retaining ring 48 includes a retaining flange 98 that clamps the tub wall 100 (dotted-line illustration) to the housing 46. The retaining ring 48 includes an internal ridge 102 that is designed to mate with the above-described groove 44 of the tabs 42 (FIGS. 6 and 7) of the faceplate assembly 12 in a snap-fit relationship.

The multi-jet assembly 10 is assembled by threading the retaining ring 48 into the internal threads 68 of the housing 46. The rear valve plate 50 is positioned in the counterbore 80 of the manifold plate 54. The manifold plate 54 is then threaded into the internal threads 66 of the housing 46 with the above-described key 74 located in the notch 72. The manifold plate 54 can thus be freely rotated about the axis $A_x$ within the arc defined by the notch 72 with engagement between the key 74 and the ends of the notch 72 defining the limits of movement. Thereafter, the helical spring 56 is placed into the cavity defined by the annular wall 92 and the posts 84 of the front valve plate 36 (not shown in FIG. 8) are inserted into the post-receiving members 88 of the manifold plate 54. Thereafter, the faceplate assembly 12 is inserted into the retaining ring 48 with its stem 38 inserted into and received by the stem receiver 70 of the rear valve plate 50. The faceplate assembly 12 is pressed into the retaining ring 48 until the groove 44 on each of the tabs 42 snaps into engagement with the ridge 102 formed on the interior wall of the retaining ring 48. In the assembled state, the front surface of the front valve plate 36 is resiliently biased into engagement with the rear surfaces of the retainer caps 20 of the various nozzle stations by the helical spring 56. As the faceplate assembly 12 is rotated, the stem 38 and stem receiver 70 connection also rotates the rear valve plate 50 captured in the manifold plate 54.

When the faceplate assembly 12 is in one of its operative positions, e.g., FIG. 1, water under pressure in the water chamber 60 will pass through three of the six venturi-type openings 76 of the rear valve plate 50, through the co-aligned distribution tubes 28, and through the openings 86 of the front valve plate 36 toward and into the ball bores 24 of the ball-type nozzle 14. As the water streams exit the ends of the distribution tubes 28, air within the air plenum 64 will be entrained within the air stream as it enters the ball bore 24 and passes through the ball bore 24 into the interior of the tub to provide three user-pointable water/air streams.

As the user rotates the faceplate assembly 12 to select the swirler-type nozzles 16 of FIG. 2, the faceplate assembly 12 rotates within the retaining ring 48 with the rear surface of the retainer caps 20 wiping across the front surface of the front valve plate 36 intermediate the openings 86. As the retainer caps 20 for the ball-type nozzles 14 move out of alignment with the openings 86 and onto the front surface of the front valve plate 36 between positions, any flow through the various nozzle stations is cut off or interrupted. Concurrent with the motion of faceplate assembly 12, the rear valve plate 50, through the stem 38 and stem receiver 70 connection, also simultaneously rotates with the faceplate assembly 12. As the rear valve plate 50 rotates, the three venturi-type openings 76 that were co-aligned with the three distribution tubes 28 wipe across the rear surface of the counterbore 80 to substantially interrupt water flow into the distribution tubes 28 as the faceplate assembly 12 is being moved from one position to the other position by the user. As the user continues to move the faceplate assembly 12 to the other position, the rear surface of the retainer caps 20 for the swirler-type nozzles 16 will co-align with the openings 86 of the front valve plate 36. Concurrent with the motion of faceplate assembly 12, the rear valve plate 50, through the stem 38 and stem receiver 70 connection, will simultaneously rotate with the faceplate assembly 12. As the rear valve plate 50 rotates, three venturi-type openings 76 will co-align with the three distribution tubes 28 to resume water flow through each of the distribution tubes 28 into the entry ports 32 of the swirl-rotors 30.

When rotating the faceplate assembly 12 between nozzle-selection positions, the user will observe a near complete interruption of water flow as the faceplate assembly 12 is moved away from one nozzle position toward the other nozzle position followed by a resumption of flow when the faceplate assembly 12 moves into the other nozzle position.

The present invention advantageously provides an user-selectable multi-jet assembly for jetted baths/spas in which the user can easily and conveniently select one of a plurality of nozzle types.

As will be apparent to those skilled in the art, various changes and modifications may be made to the illustrated user-selectable multi-jet assembly for jetted baths/spas of the present invention without departing from the spirit and scope of the invention as determined in the appended claims and their legal equivalent.

What is claimed is:

1. A multi-jet assembly for jetted baths/spas comprising:

a housing having an inlet for receiving a flow of water under pressure;

a faceplate assembly rotatably connected to said housing and rotatable by a user between first and second user-selectable positions, said faceplate assembly having at least one nozzle of a first type and at least one nozzle of a second type; and a water distributor within said housing for directing water to said at least one nozzle of said first type when said faceplate assembly is in said first position and to said at least one nozzle of said second type when said faceplate assembly is in said second position, said water distributor interrupting flow to said nozzles when said faceplate assembly is in a position intermediate said first and second user-selectable positions and said water distributor having a valve plate in engagement with said faceplate assembly and rotatable therewith, said valve plate having an opening in registration with a water distribution tube when said faceplate assembly is in either of its user-selectable positions.

2. The multi-jet assembly for jetted baths/spas of claim 1, wherein said nozzle of the first type is a pointable ball nozzle.

3. The multi-jet assembly for jetted baths/spas of claim 1, wherein said nozzle of the second type is a swirling-jet nozzle.

4. A multi-jet assembly for jetted baths/spas comprising:

a housing having an inlet for receiving a flow of water under pressure;

a faceplate assembly rotatably connected to said housing and rotatable by a user between first and second user-selectable positions, said faceplate assembly having at least two nozzles of a first type and at least two nozzles of a second type; and a water distributor within said housing for directing water to said at least two nozzles of said first type when said faceplate assembly is in said first position and to said at least two nozzles of said second type when said faceplate assembly is in said second position, said water distributor interrupting flow to said nozzles when said faceplate assembly is in a position intermediate said first and second user-selectable positions and said water distributor having a valve plate in engagement with said faceplate assembly and rotatable therewith, said valve plate having an opening in registration with a water distribution tube when said faceplate assembly is in either of its user-selectable positions.

5. The multi-jet assembly for jetted baths/spas of claim 6, wherein said nozzles of the first type are pointable ball nozzles.

6. The multi-jet assembly for jetted baths/spas of claim 4, wherein said nozzles of the second type are swirling-jet nozzles.

7. A multi-jet assembly for jetted baths/spas comprising:

a housing having an inlet for receiving a flow of water under pressure and a water-receiving chamber within said housing;

a water-distributing stator within said housing for distributing water into a plurality of distribution tubes; and a water-controlling rotor cooperating with said stator for selectively interrupting water flow through said plurality of distribution tubes as a function of the rotary position of said rotor relative to said stator;

said water-controlling rotor including a faceplate assembly rotatably mounted in said housing and movable between first and second user-selected positions, said faceplate assembly having at least a first plurality of nozzles of a first type equal in number to said plurality of distribution tubes and a second plurality of nozzles of a second type therein equal in number to said plurality of distribution tubes, said rotor having a valve plate connected to said faceplate assembly and having a number of bores therein for movement in registration with said distribution tubes when said faceplate assembly is in a user-selected position and whereby rotation of said faceplate assembly and connected valve plate interrupts water flow to distribution tubes at positions intermediate said first and second user-selected positions.

8. The multi-jet assembly for jetted baths/spas of claim 7, wherein said nozzles of the first type are pointable ball nozzles.

9. The multi-jet assembly for jetted baths/spas of claim 7, wherein said nozzles of the first type are swirling-jet nozzles.

* * * * *